United States Patent [19]

Waltzer

[11] Patent Number: 4,537,340

[45] Date of Patent: Aug. 27, 1985

[54] SUPPORT BRACKET FOR ELECTRONIC REMOTE CONTROL MODULE

[76] Inventor: Jeremy Waltzer, 22 Victorian La., Brookville, N.Y. 11545

[21] Appl. No.: 527,243

[22] Filed: Aug. 29, 1983

[51] Int. Cl.[3] ..... A45C 11/00

[52] U.S. Cl. ..... 224/202; 224/257

[58] Field of Search ..... 224/202, 204, 205, 207, 224/208, 209, 210, 211, 257, 261, 262, 42, 42 R; 294/144, 145, 172, 311 R, 27 R, 1 R

[56] References Cited

U.S. PATENT DOCUMENTS

| | | | |
|---|---|---|---|
| 2,566,464 | 9/1951 | Redenback | 224/261 |
| 2,995,281 | 8/1961 | Dixon | 224/208 |
| 3,273,484 | 9/1966 | Lapsley | 224/257 |
| 3,541,976 | 11/1970 | Rozas | 224/208 |

*Primary Examiner*—Stephen Marcus
*Assistant Examiner*—David Voorhees
*Attorney, Agent, or Firm*—Alfred Musumeci

[57] ABSTRACT

A support device to enable a remote control module to be conveniently held and used in a portable manner including a pair of parallel support arms adapted to support a control module therebetween, a brace member adapted to be braced against the body of a user and extending generally perpendicularly to said support arms for a distance greater than the spacing therebetween, and a pair of intermediate arms extending between the support arms and the brace member obliquely relative to both. During use, the assembly may be engaged against the intermediate members to hold the module while permitting the fingers of the hands to remain free for manipulation of the switches, dials, and other control members of the control module.

5 Claims, 4 Drawing Figures

SUPPORT BRACKET FOR ELECTRONIC REMOTE CONTROL MODULE

The present invention relates generally to remote control devices and more particularly to means for enabling an electronic remote control module to be conveniently held while in use.

In the art of remote control devices, it is often necessary to carry a control device or module which contains the controls for a remotely operated device. Such a module may contain a multiplicity of switches, knobs, dials, and the like which must be simultaneously moved and manipulated with precision in order to effect remote control of a mechanism to be guided or operated.

Usually, such a control module must be a portable device and it must be carried about from place to place during use.

The necessity for carrying the control module from place to place while in use and to simultaneously manipulate all the knobs, switches, etc. which must be operated while in use, creates many problems for a user of such a device. In the first instance, the fingers of the user must be occupied with turning or manipulating the switches or dials of the control module. Thus, it is difficult for a user to simultaneously hold and support the control module and to also manipulate the switches and dials thereof. The problem becomes particularly acute when rapid movement from place to place is required during use.

Accordingly, the present invention is directed to providing a device which will enable a remote control module to be carried about as a portable item and to be conveniently held and supported by a user while at the same time enabling ease of operation and manipulation of the various switches, dials, knobs, etc., of the control module.

SUMMARY OF THE INVENTION

Briefly, the present invention may be described as a support bracket for an electronic remote control module adapted to enable the module to be conveniently held and braced against the body while in use to facilitate operation thereof with both hands comprising: a pair of generally parallel support arms extending in spaced apart relationship to each other adapted to hold therebetween an electronic remote control module; a brace member extending generally perpendicularly to said support arms adapted to be placed against the body of a user to enable said bracket to be braced thereby while in use, said brace member extending across a distance greater than the spacing between said support arms; and a pair of intermediate members each extending, respectively, from one end of each support arm between said support arms and said brace member, said intermediate members being arranged to extend obliquely relative to both said support arms and said brace member thereby to enable the inner sides of the wrists of a user to rest thereagainst during operation of a control module mounted between said support arms.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
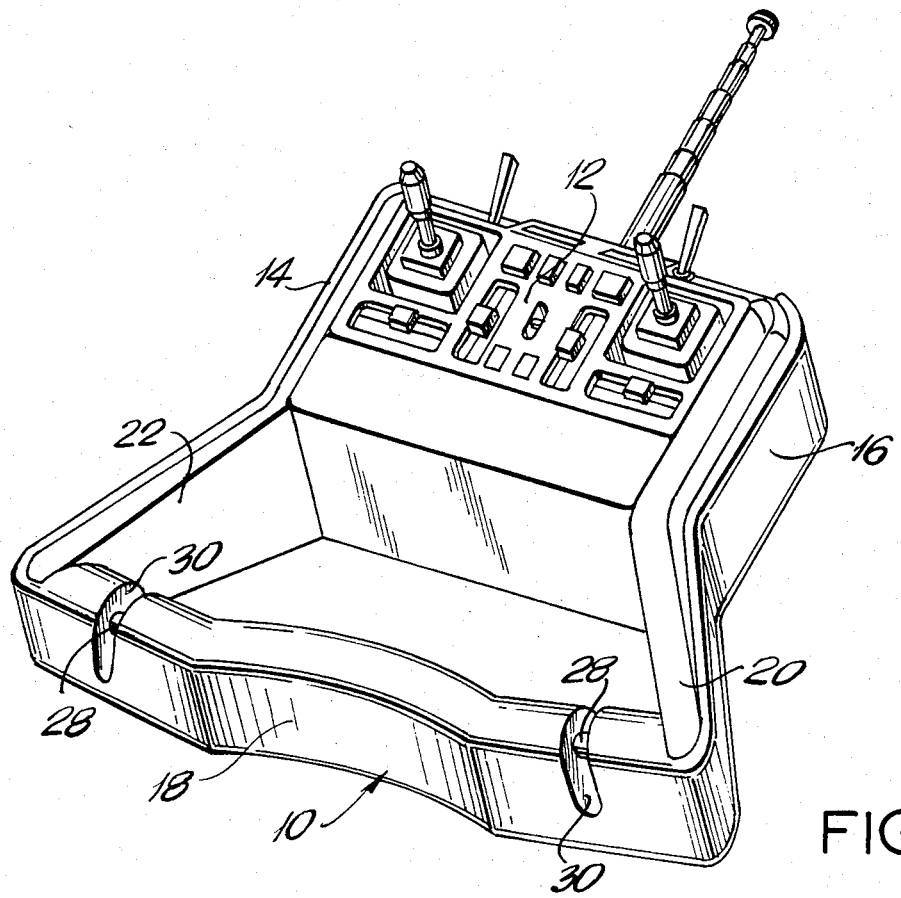
FIG. 1 is a perspective view showing an embodiment of the present invention formed as a unitary member and having a remote control module mounted therein.
Figure 2:
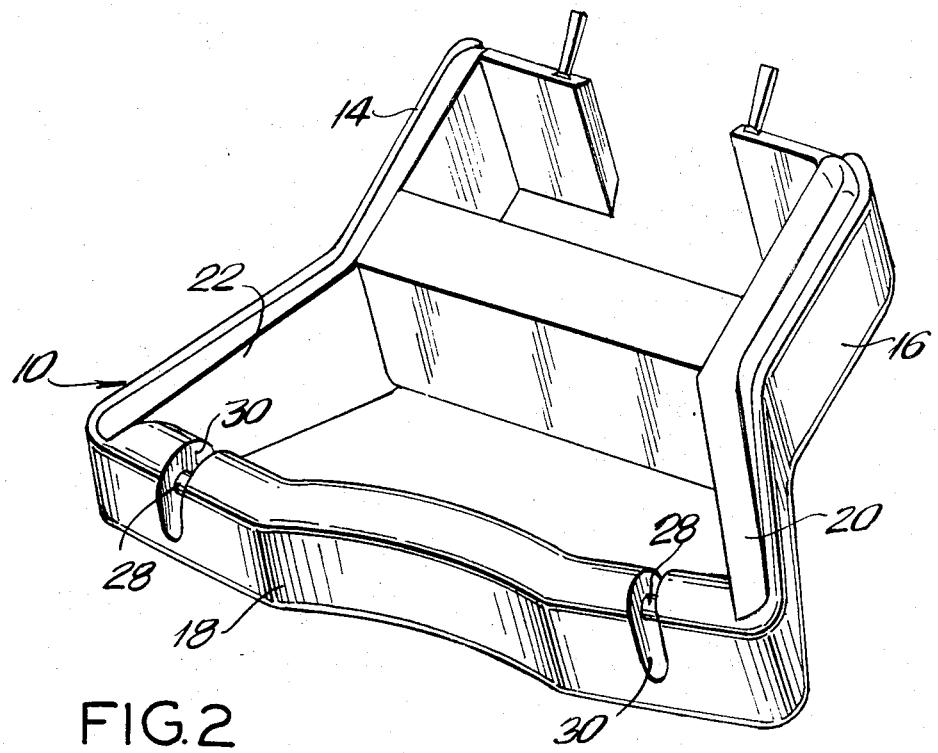
FIG. 2 is a perspective view of the support bracket of FIG. 1 shown without the remote control module.

Referring now to the drawings, and particularly to FIGS. 1 and 2, there is shown a first embodiment of the invention which comprises a support bracket 10 adapted to have mounted therein an electronic remote control module 12. As will be noted from FIG. 1, the module 12 contains a plurality of various types of switches, dials, knobs, etc., and is arranged in supported engagement between a pair of generally parallel support arms 14 and 16 located on either side of the control module 12. In FIG. 2, the bracket 10 is shown with the module 12 removed.

The module 12 may be either permanently implanted into the bracket 10 between the arms 14 and 16 or it may be removably fitted therein, in which case the module may be removed and the bracket may be utilized for use with different modules.

Figure 4:
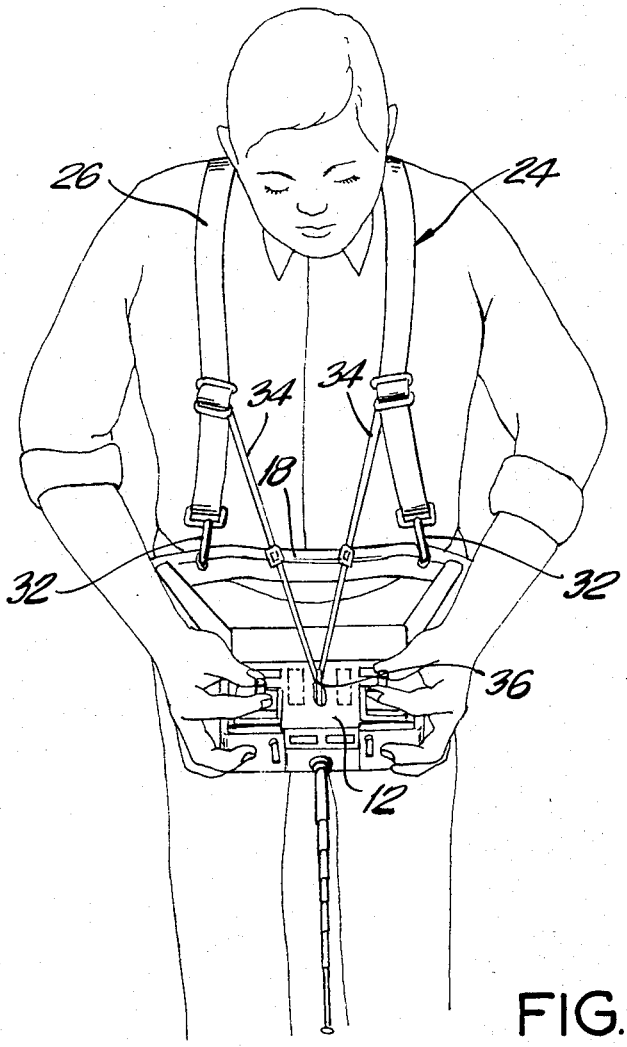
FIG. 4 is a perspective view depicting another embodiment of the invention while in use.

The bracket 10 also includes a brace member 18 which is adapted to be pressed against the abdomen of the body of a user, as is best seen in FIG. 4, in order to facilitate operation of the control module 12. It will be noted that the brace member 18 extends with a length which is greater than the distance between the support arms 14 and 16.

A pair of intermediate members 20 and 22 extend between the support arms 14, 16 and the brace member 18. It will be noted that, in each case, one of the intermediate members 20, 22 extends from one of the ends of the support arms 14, 16 and that the arms 20, 22 extend between the support arms 14, 16, respectively, and the brace 18. It will further be noted that the brace 18 has a length dimension which extends generally perpendicularly to the support arms 14, 16 and that the intermediate members 20, 22 extend obliquely to both the support arms 14, 16 and to the brace 18.

The mode of operation of the support bracket of the invention is best seen in FIG. 4. In FIG. 4, the arrangement is shown with a strap harness 24 supporting the assembly from the shoulders of a user. However, the harness 24 is not necessary and the device may be utilized without the harness 24. In use, the inner sides of the wrists of the operator are placed against the outer sides of the intermediate members 20, 22 and by pressing the wrists against the sides of the support bracket, the support bracket may be held with the brace member 18 supported against the abdomen of the user, as shown in FIG. 4. This will leave the fingers of the user unencumbered so that the various dials, knobs, etc. of the module 12 may be manipulated.

FIG. 4 shows a further embodiment of the invention wherein the harness 24 is attached to extend about the neck and shoulders of the user between the support bracket and the control module 12. As will be seen, the harness 24 includes a strap member 26 which extends between attachment pins 28 located within recesses 30 formed in the brace member 18. The strap 26 includes a pair of hooks 32 which are engaged about the pins 28 and which thereby hold the brace member 18 so that it may be supported upon the shoulders of the user.

An additional pair of straps 34 extend from the strap 26 to around an eyelet 36 which may be formed either in the control module itself or as part of the bracket member 10.

With the shoulder harness in place as shown in FIG. 4, the assembly may be utilized in the manner previously described except that instead of relying solely upon the sideward pressure which is applied by the inner sides of the wrists of the user, a better support arrangement is provided in that the straps make for a more secure mounting. Of course, the brace member 18 is, in each case, braced against the abdomen of the user and the control module may be very securely held and easily manipulated without difficulty.

Figure 3:
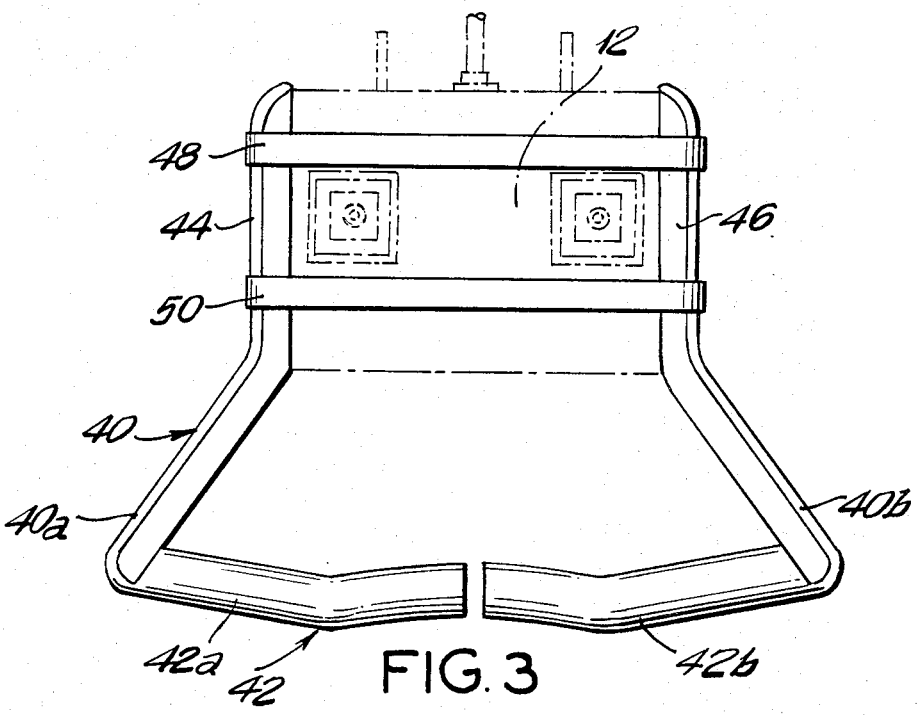
FIG. 3 is a top view of a further embodiment of the invention.

FIG. 3 shows a further embodiment of the invention wherein the bracket is formed in two parts. In FIG. 3, there is shown a bracket 40 which is made of two bracket members 40*a* and 40*b*. The bracket 40 includes a brace member 42 which likewise is formed in two parts 42*a* and 42*b* with a separation therebetween being shown in FIG. 3. The bracket 40 includes a pair of support arms 44 and 46 between which a control module such as the control module 12 may be mounted. In the case of the embodiment of FIG. 3, a pair of mounting straps 48, 50 are provided which extend about the arms 44, 46 in order to tightly grip the arms 44, 46 and apply a force drawing them together. As a result, when the module 12 is placed between the arms 44 and 46, the straps 48 and 50 may be tightened so as to firmly hold the module 12. In this arrangement, the bracket 40 may be used in a manner identical to that previously described in connection with the bracket 10 and the bracket 40 may or may not be adapted for use with a harness such as the harness 24.

Thus, it will be seen that the invention provides a rather versatile support bracket for a remote control module which will enable the module to be portable and to be easily supported while in use or operation. The module may be simply held by utilizing the bracket 10 without the harness 24 simply by supporting the brace member 18 against the abdomen of the user while the inner sides of the wrists are pressed against the outer sides of the intermediate members 10 and 20.

Alternatively, a harness such as the harness 24 shown in FIG. 4 may be utilized.

As indicated, the bracket may be made either as a unitary member, as depicted in FIGS. 1 and 2, or as a bipartite member, as shown in FIG. 3.

While specific embodiments of the invention have been shown and described in detail to illustrate the application of the inventive principles, it will be understood that the invention may be embodied otherwise without departing from such principles.

What is claimed is:

1. A support bracket for an electronic remote control module adapted to enable the module to be conveniently held and braced against the body while in use to facilitate operation thereof with both hands comprising: a pair of generally parallel support arms extending in spaced apart relationship to each other adapted to hold therebetween an electronic remote control module; a brace member extending generally perpendicularly to said support arms adapted to be placed against the body of a user to enable said bracket to be braced thereby while in use, said brace member extending across a distance greater than the spacing between said support arms; and a pair of intermediate members each extending, respectively, from an end of one of said support arms between said support arms and said brace member, said intermediate members being arranged to extend obliquely relative to both said support arms and said brace member thereby to enable the inner sides of the wrists of a user to rest thereagainst during operation of a control module mounted between said support arms.

2. A bracket according to claim 1 further comprising a harness including a strap adapted to be connected at two opposite ends thereof with said brace member and to extend behind the neck of a user to assist in supporting said support bracket and said control module.

3. A bracket according to claim 2 wherein said strap further includes means connecting said strap along two points thereof proximate the chest area of a user with said support bracket containing a remote control module.

4. A bracket according to claim 1 wherein said support arms are arranged in fixed relationship relative to each other and wherein a cavity is defined between said support arms within which an electronic support module may be held.

5. A bracket according to claim 1 formed as two separable bracket members, each of said bracket members being formed to include one of said support arms, one of said intermediate members, and a part of said brace member, said brace member being thereby formed as a discontinuous member, said bracket further comprising strap means adapted to be engaged about said support arms to firmly hold a control module therebetween.

* * * * *